United States Patent [19]

Frank

[11] 4,302,000

[45] Nov. 24, 1981

[54] APPARATUS FOR SEPARATING A LETTER STACK

[75] Inventor: Werner Frank, Reichenau, Fed. Rep. of Germany

[73] Assignee: Licentia Patent-Verwaltungs-G.m.b.H., Frankfurt am Main, Fed. Rep. of Germany

[21] Appl. No.: 97,912

[22] Filed: Nov. 28, 1979

[30] Foreign Application Priority Data

Nov. 29, 1978 [DE] Fed. Rep. of Germany ..... 2851545

[51] Int. Cl.[3] ..... B65H 1/02; B65H 1/14; B65H 1/24

[52] U.S. Cl. ..... 271/150; 271/34; 271/148; 271/153

[58] Field of Search ..... 271/150, 149, 30 A, 271/129, 152, 153, 154, 155, 126, 34, 22, 24, 10, 147, 148, 160; 414/118, 119; 221/279

[56] References Cited

U.S. PATENT DOCUMENTS

| | | | |
|---|---|---|---|
| 622,106 | 3/1899 | Berry | 271/149 X |
| 2,291,010 | 7/1942 | Vergobbi | 271/150 X |
| 2,969,235 | 1/1961 | Billet et al. | 271/129 |
| 3,125,337 | 3/1964 | Cruzen | 271/154 |
| 3,194,549 | 7/1965 | Wirtz | 271/150 X |
| 3,527,456 | 9/1970 | Swartz | 271/3 |
| 3,981,493 | 9/1976 | Klappenecker et al. | 271/10 |
| 4,077,620 | 3/1978 | Frank et al. | 271/10 |

FOREIGN PATENT DOCUMENTS

| | | | |
|---|---|---|---|
| 300514 | 6/1915 | Fed. Rep. of Germany | 271/160 |
| 2613261 | 10/1977 | Fed. Rep. of Germany | 271/10 |

*Primary Examiner*—Bruce H. Stoner, Jr.
*Attorney, Agent, or Firm*—Spencer & Kaye

[57] ABSTRACT

In apparatus for the separate discharge of flat items from a stack of such items, which apparatus includes a movable support for supporting the stack of items, a withdrawal mechanism mounted to engage the foremost item in the stack and withdraw that item from the stack, a supporting wall manually movable into an initial position for supporting the trailing end of the stack, and a drive system connected to drive the supporting wall toward the withdrawal mechanism under control of the state of a switch actuated in dependence upon the force being exerted by the stack on the withdrawal mechanism, resilient force equalizing elements are provided between the drive system and the supporting wall in drive transmitting relation therebetween, and are constructed and mounted for permitting advancing movement of the supporting wall to lag behind that corresponding to the sum of the drive movements produced by the drive system whenever the pressing force between the supporting wall and the stack exceeds a given value.

5 Claims, 2 Drawing Figures

APPARATUS FOR SEPARATING A LETTER STACK

BACKGROUND OF THE INVENTION

The present invention relates to an apparatus for the separate discharge of letters and similar flat items from a stack of such items, the apparatus being of the type including a movable support supporting the stack of items, a rotating withdrawal mechanism in engagement with the foremost item in the stack, means defining a supporting wall manually movable into an initial position for supporting the trailing end of the stack, a motor connected to drive the supporting wall toward the withdrawal mechanism under control of a switch actuated in dependence upon the force being exerted by the stack on the withdrawal mechanism.

The movable support in such apparatus is usually a movably mounted endless base belt which is likewise driven in dependence on the actuation on the above-mentioned switch in the direction toward the separating belt, generally at the same speed as the supporting wall. Such a device is disclosed, for example, in U.S. Pat. No. 3,981,493 and is shown in FIGS. 1 and 5 thereof.

Controlling the drive for the supporting wall in dependence on the force exerted by the stack on the withdrawal mechanism has the purpose of keeping this force essentially constant. This is necessary because the withdrawal mechanism operates reliably, i.e., with a minimum of removal errors, in particular a minimum of double removals, only within a certain range of contact force.

For structural reasons, however, in the known devices the above object is not attained under certain operating conditions. The speed at which the supporting wall and the base belt are to be advanced, or driven, should be selected high enough that even if successive thick items of mail are discharged the stack will follow rapidly enough. Since on the other hand, the effective on period of the drive cannot be made less than about 0.1 second, the minimum attainable incremental displacement of the supporting wall and the base belt during each switch-on phase is, for example, about 2 to 3 mm. This may lead to difficulties during discharge of successive thin items, such as postcards, for example. Due to the slip between the stack and the base belt, in conjunction with the on-off hysteresis of the microswitch based on the stack contact force, a plurality of such minimum displacements may be combined with the result that the supporting wall undergoes a displacement greater than that corresponding to the reduction in stack length due to the removal of the thin items. The resulting temporary compaction, associated with an increase of the stack contact force, with decreasing stack length, or if the stack contains essentially only thin and hard items, may have the result that the pressure force exerted by the stack against the withdrawal mechanism takes on unduly high values and produces operating malfunctions.

SUMMARY OF THE INVENTION

It is therefore an object of the present invention to improve the operation of such apparatus in such a manner that even if thin and hard items are removed from short stacks the contact force exerted by the stack against the withdrawal mechanism will not attain unduly high values.

This and other objects are achieved, according to the invention, in apparatus of the type described initially herein, by interposing resilient force equalizing means between the output of the motor and the supporting wall so that the motor output is delivered to the wall via the equalizing means, and by constructing the equalizing means so as to permit advancing movement of the supporting wall to lag behind that corresponding to the sum of the drive movements produced by the motor output whenever the pressing force between the supporting wall and the stack exceeds a given value.

DESCRIPTION OF THE PREFERRED EMBODIMENTS

Figure 1:
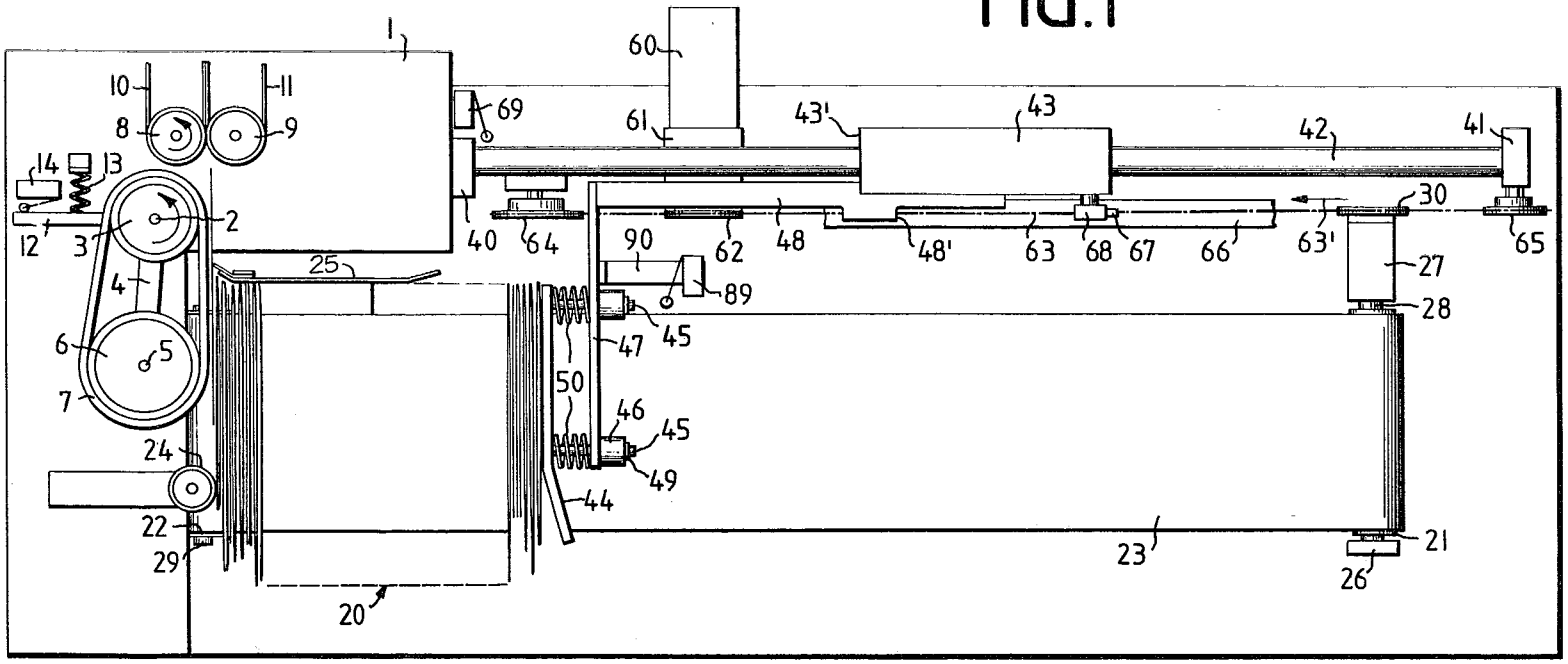
FIG. 1 is a simplified top plan view, the basic components of a first preferred embodiment of separating apparatus according to the invention.

FIG. 1 illustrates apparatus including a base plate 1 on which a shaft 2 is mounted to be freely rotatable. A roller 3 is fastened to shaft 2. The shaft 2 itself serves to pivotally hold a rocker 4 which carries the shaft 5 of a withdrawing roller 6 as illustrated in detail, for example, in the above-cited U.S. Pat. No. 3,981,493. A withdrawal belt 7 whose outer surface has a high coefficient of friction is trained around the roller 3 and the withdrawal roller 6.

The shaft 2 is driven in the direction of the arrow associated therewith by means of a conventional electromagnetic clutch and a motor (both now shown). A conventional stripper disposed opposite the roller 3 is also not shown. A stack 20 of items is mounted on a base belt 23 and items separated from the stack are brought into a continuing conveying path of which two conveyor belts 10 and 11, which are guided around two rollers 8 and 9, are shown.

An arm 12 is fastened to rocker 4 and a compression spring 13 is held between base plate 1 and arm 12. A microswitch 14 is also mounted on base plate 1 and is arranged to be actuated by arm 12, its function being described further below. Since, due to its pivotal mounting and the action of spring 13, the angular position of rocker 4 depends on the pressing force exerted by the stack 20 against the withdrawal belt 7, the switch 14 is actuated in a respective direction whenever this pressure force exceeds or falls below a certain given value.

The movable support for the stack 20 is the base belt 23 guided around end rollers 21 and 22. The leading item of the stack 20 is supported by a freely rotatable roller 24. Along the discharge side, the stack 20 is supported laterally by a rigid abutment wall 25. The bearings 26 and 27 for the shaft 28 supporting roller 21 are connected with the machine frame in a manner which is not illustrated. The base plate 1 is also part of the machine frame. The similar bearings for the shaft 29 supporting roller 22 are not shown. A sprocket wheel 30 which transmits the drive power to the base belt 23 is seated on shaft 28.

A cylindrical guide bar 42 is fastened to blocks 40 and 41 and extends parallel to the direction of advance of base belt 23. In the embodiment shown in FIG. 1, a guide sleeve 43 is mounted to be displaceable along and pivotal about the cylindrical guide bar 42. In order to reduce fricton, this guide sleeve 43 may be supported on bar 42 via one or two ball bearing sleeves. The guide sleeve serves to guide and advance a supporting wall 44 which supports the trailing end of stack 20.

This supporting wall 44 is mounted by means of two bolts 45 which are displaceable longitudinally in sleeves 46 of an arm 47 which is disposed behind and parallel to the supporting wall 44. The path of displacement of the supporting wall 44 with respect to arm 47 is limited by retaining rings 49, such as circlips, which are held on bolts 45 and serve as abutments for sleeves 46. Between the supporting wall 44 and the arm 47 there are mounted compression springs 50 which tend to maintain a maximum distance between the wall 44 and the arm 47 as defined by the locations of rings 49.

To jointly drive the base belt 23 and the supporting wall 44, a motor 60 is provided. The output shaft of motor 60 drives a sprocket wheel 62 via an electrically engageable magnetic clutch 61. The switch 14 is included in the engagement circuit of the magnetic clutch 61 and is connected in such a way that the sprocket wheel 62 is driven whenever the force with which the leading item of stack 20 presses against the removal belt 7 falls below a given value, i.e., whenever the state of switch 14 corresponds to the extended position of its feeler.

The sprocket wheel 62 engages an endless chain 63, represented by a dot-dash line, which is brought around two freely rotatably mounted guide wheels 64 and 65. The upper reach of the chain 63, which is driven in the direction of the arrow 63', rests only on a supporting rail 66, only a section of which is shown.

The chain 63 transmits the rotation of sprocket wheel 62, on the one hand, to the base belt 23 via the sprocket wheel 30 and, on the other hand, to the guide sleeve 43, and thus to the supporting wall 44, via a lug 67 which acts as a directional block. By means of a spring-tensioned hub 68, the lug 67 is pivotally fastened to the guide sleeve 43. In the illustrated position lug 67 engages the chain 63 from the top in such a manner that it permits free manual displacement of the guide sleeve toward the left while preventing, or blocking, movement of the guide sleeve to the right relative to chain 63. The guide sleeve 43 is thus carried along to the left by chain 63 if the latter is being driven.

If the supporting wall 44 is to be shifted toward the right in order to insert or supplement a stack 20, it, together with sleeve 43, is manually pivoted through an angle of about 90°, around the axis of bar 42, toward the top, thus releasing the engagement between lug 67 and chain 63. In the operating position shown in FIG. 1, the supporting wall 44 and the other components fastened to the guide sleeve 43 are supported by a support 48' formed by rod 48 and resting on the chain 63.

The springs 50 are advantageously dimensioned to be under compression when parts 44 and 47 are a maximum distance apart so that they have a relatively flat spring characteristic as those parts are forced together. Springs 50 are dimensioned empirically so that when thin and hard items are to be removed, the temporarily resulting excess displacements imposed by motor 60 are compensated as well as possible, so that the supporting wall 44 remains within the limits of its possible movement.

According to a feature of the invention, a further switch 69 is included in the circuit of the drive, i.e. in the circuit of the magnetic clutch 61, so as to cooperate with the frontal face 43' of the guide sleeve 43 or of another element which defines the path of advancement for the drive of the supporting wall 44. The switch is arranged in such a way that it cuts off the drive for the supporting wall 44 and the base belt 23 if the supporting wall 44 has been moved to such an extent that it is disposed immediately adjacent the withdrawal belt 7 when the springs 50 are in their most expanded state, i.e. the circlips 49 rest against the sleeves 46.

If the switch 69 is present, the springs 50 can be dimensioned so that the distance between the supporting wall 44 and the arm 47 is generally small, at least once the guide sleeve 43 has reached its end position at the switch 69. The further reduction in length of the stack to zero, during the further course of the withdrawal process, is then compensated only by the advance of the supporting wall 44 under the influence of the force of the springs 50.

Figure 2:
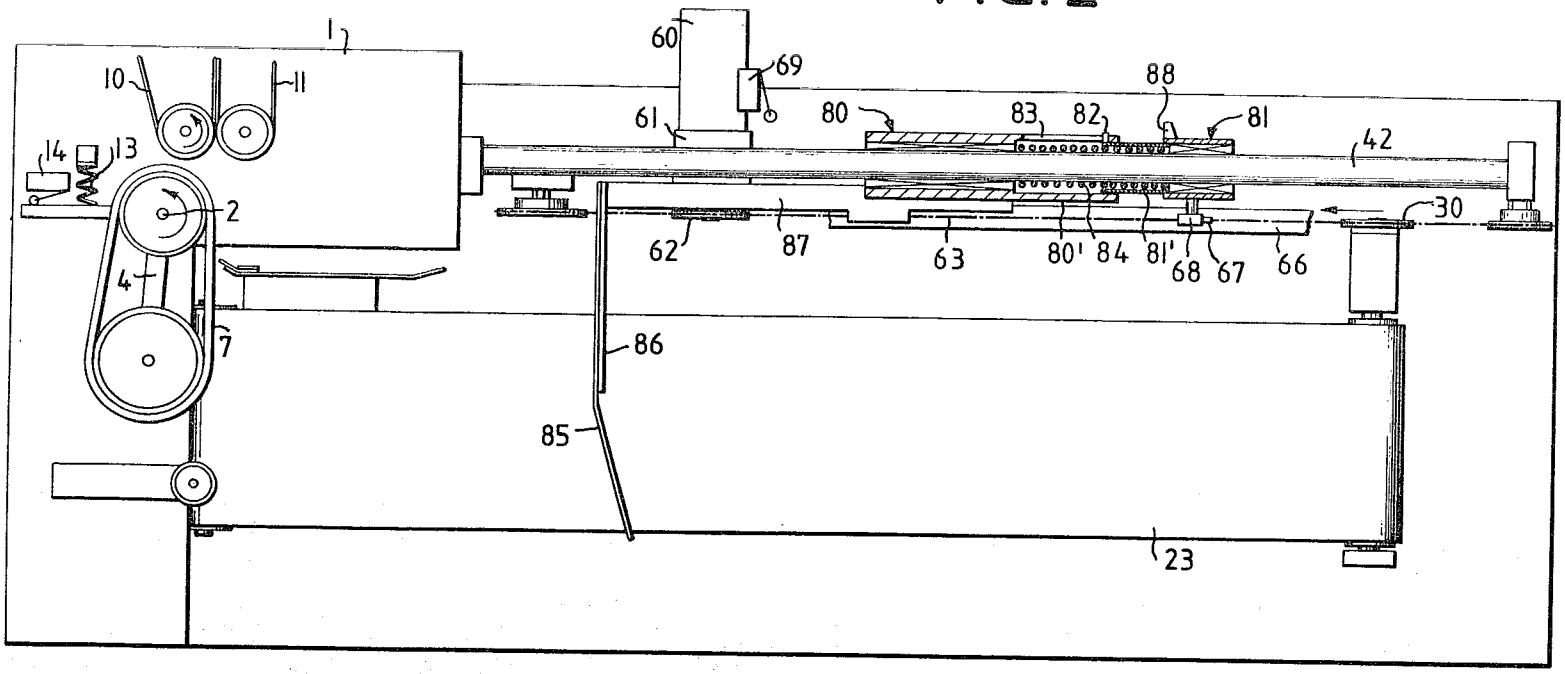
FIG. 2 is a view similar to that of FIG. 1 of a second preferred embodiment of apparatus according to the invention.

The embodiment shown in FIG. 2 corresponds with the above-described embodiment with respect to elements 1 through 42 and 60 to 69. It differs from that embodiment in that the resilient compensating member is included at another point in the path of force transmission between the drive and the supporting wall.

Specifically, a guide sleeve 80 and a second sleeve 81 are mounted by means of ball bearing guide sleeves on the guide bar 42 so as to be longitudinally displaceable along, and rotatably relative to, bar 42. Sleeves 80 and 81 are shown in FIG. 2 in section. Sleeve 80 has a member 80' which engages a member 81' of sleeve 81 in a telescope-like sliding manner. Member 81' is provided with a pin 82 which engages in a longitudinal slot 83 provided in member 80'. Slot 83 is closed at both axial ends. Thus the guide sleeve 80 and the second sleeve 81 are longitudinally displaceable between two end positions and are connected together without being rotatable relative to one another. Concentrically with the guide bar 42, a compression spring 84 is interposed between guide sleeve 80 and sleeve 81 which spring 84 tends to maintain the maximum distance between these two members as shown in the drawing and defined by pin 82.

The hub 68 of lug 67 is fastened to sleeve 81. A supporting wall 85 is rigidly fastened to the guide sleeve 80 by means of an arm 86 and a rod 87. The actuation of the switch 69 is effected by means of a tongue 88 secured to sleeve 81. Otherwise, the two illustrated embodiments of the present invention operate in the same manner.

Instead of switch 69, or in addition thereto, a further feature of the invention provides a further switch in series with switch 14 so as to additionally switch off the drive for chain 63 whenever the movement of the supporting wall lags behind the displacement corresponding to the sum of the drive movements imposed by rotation of wheel 62 by the maximum amount made possible by the resilient equalizing member.

In FIG. 1, for this purpose a further switch 89 is fastened to arm 47 by means of a bar 90 to be actuated by the end of the corresponding one of bolts 45 whenever the springs 50 are in their most compressed state.

With reference to FIG. 2, this further switch and its actuating member would be fastened on guide sleeve 80 or on sleeve 81, respectively, and would respond, for example, when, and as long as, the distance between these two members has reached the smallest possible value.

Again referring to FIG. 1, in a practical embodiment the length of the path of movement of the supporting wall 44 has been 50 millimeters. Springs 50 have been dimensioned such that near the beginning of said movement the resulting force has been equal to 10 newtons and near the end of movement equal to 22 newtons.

It will be understood that the above description of the present invention is susceptible to various modifications, changes and adaptations, and the same are intended to be comprehended within the meaning and range of equivalents of the appended claims.

What is claimed is:

1. In apparatus for the separate discharge of letters and similar flat items from a stack of such items, which apparatus includes a movable support for supporting the stack of items, a withdrawal mechanism mounted to engage the foremost item in the stack and withdraw that item from the stack, means defining a supporting wall manually movable into an initial position for supporting the trailing end of the stack, and drive means connected to drive the supporting wall toward the withdrawal mechanism under control of the state of a switch actuated in dependence upon the force being exerted by the stack on the withdrawal mechanism, the improvement wherein:

said apparatus further comprises resilient force equalizing means between said drive means and said supporting wall in drive transmitting relation therebetween, said equalizing means being constructed and mounted for permitting advancing movement of said supporting wall to lag behind that corresponding to the sum of the drive movements produced by said drive means whenever the pressing force between said supporting wall and the stack exceeds a given value, and a guide bar extending parallel to the direction in which said supporting wall is driven;

said drive means comprise: a guide sleeve rigidly connected to said supporting wall and mounted on said bar for displacement therealong; a motor; a motion transmission member connected to the output of said motor to be driven thereby; a releasable connecting member connecting said motion transmission member in driving relationship with said sleeve; and a second sleeve carrying said releasable connecting member and mounted on said bar for displacement therealong and relative to said first-recited sleeve;

and said resilient force equalizing means comprise spring means mounted between said sleeves for producing a force urging said first-recited sleeve relative to said second sleeve in the direction toward said withdrawal mechanism, and abutment means arranged between said sleeves for delimiting the distance established therebetween by the force produced by said spring means.

2. Apparatus as defined in claim 1 wherein said movable support comprises a movably mounted endless base belt.

3. Apparatus as defined in claim 2 further comprising means for driving said endless base belt toward said withdrawal mechanism under control of the state of the switch.

4. Apparatus as defined in claim 1 further comprising a supplemental switch mounted to be switched in response to movement of said drive means and connected electrically to said drive means for deactuating said drive means when said drive means reaches a position at which said supporting wall is in immediate proximity to said withdrawal mechanism when said supporting wall is not experiencing any lag in its advancing movement relative to the sum of advancing movements produced by said drive means.

5. In apparatus for the separate discharge of letters and similar flat items from a stack of such items, which apparatus includes a movable support for supporting the stack of items, a withdrawal mechanism mounted to engage the foremost item in the stack and withdraw that item from the stack, means defining a supporting wall manually movable into an initial position for supporting the trailing end of the stack, and drive means connected to drive the supporting wall toward the withdrawal mechanism under control of the state of a switch actuated in dependence upon the force being exerted by the stack on the withdrawal mechanism, the improvement comprising resilient force equalizing means between said drive means and said supporting wall in drive transmitting relation therebetween, said equalizing means being constructed and mounted for permitting advancing movement of said supporting wall to lag behind that corresponding to the sum of the drive movements produced by said drive means whenever the pressing force between said supporting wall and the stack exceeds a given value, and a supplemental switch mounted to be switched in response to movement of said drive means and connected electrically to said drive means for deactuating said drive means when said supporting wall reaches a position relative to said drive means corresponding substantially to the maximum permissible lag of said supporting wall relative to the sum of advancing movements produced by said drive means.

* * * * *